United States Patent [19]

Herbin et al.

[11] Patent Number: 4,831,789

[45] Date of Patent: May 23, 1989

[54] TOOL WHOSE SHAPE ADAPTS AUTOMATICALLY TO THE SURFACE OF AN OPHTHALMIC LENS

[75] Inventors: Patrick Herbin, Morlaincourt; Jean-Claude Lacroix, Ligny-en-Barrois, both of France

[73] Assignee: Essilor International (Compagnie Generale d'Optique), Creteil, France

[21] Appl. No.: 171,742

[22] Filed: Mar. 22, 1988

[30] Foreign Application Priority Data

Mar. 27, 1987 [FR] France ..... 87 04264

[51] Int. Cl.[4] ..... B24D 17/00

[52] U.S. Cl. ..... 51/363

[58] Field of Search ..... 51/284 R, 362, 363; 81/185; 269/266

[56] References Cited

U.S. PATENT DOCUMENTS 3,858,468 1/1975 Pasbrig ..... 81/185

FOREIGN PATENT DOCUMENTS 76279 2/1919 Austria ..... 269/266
257778 11/1986 Japan ..... 51/362
511178 8/1976 U.S.S.R. ..... 51/363
1245375 9/1971 United Kingdom ..... 51/363

*Primary Examiner*—James G. Smith
*Attorney, Agent, or Firm*—Oblon, Fisher, Spivak, McClelland & Maier

[57] ABSTRACT

This tool whose shape adapts automatically to the surface of an ophthalmic lens is suitable for use as a polisher or as an applicator buffer. It comprises a rigid support (2) having a cavity (5) in one of its faces, together with a buffer (1) constituted by two elastically deformable membranes (7 and 8) which are fixed at their peripheral edges to the side walls of the cavity (5) at a distance from the bottom thereof, thereby defining a space (9) between the membranes which is filled with an incompressible material (11) consituted by small-size grains, with the support (2) including a passage (12) having one end opening out into said space (9) and having its other end connectable to a vacuum source (15).

10 Claims, 1 Drawing Sheet

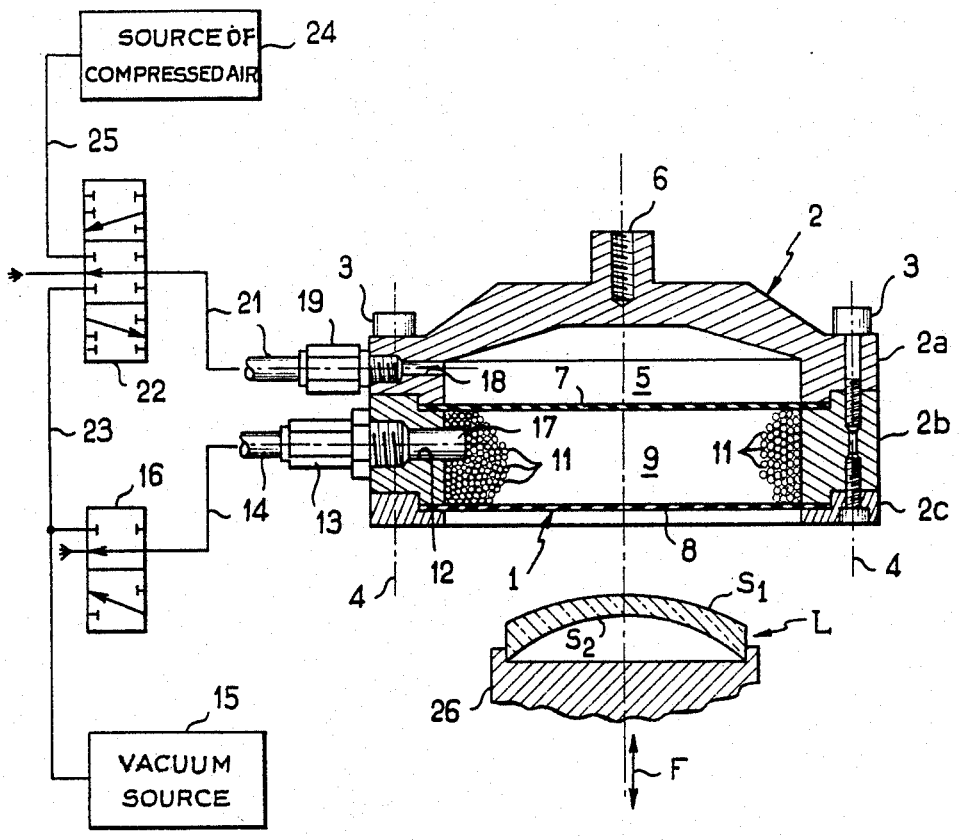
SOURCE OF COMPRESSED AIR
24
25
22
23
16
15
VACUUM SOURCE
21
19
3
18
7
5
6
2
3
2a
2b
2c
17
11
9
11
14
13
12
1
8
4
4
S1
S2
L
26
F

TOOL WHOSE SHAPE ADAPTS AUTOMATICALLY TO THE SURFACE OF AN OPHTHALMIC LENS

The present invention relates to a tool whose shape adapts automatically to the surface of an ophthalmic lens, the tool comprising a rigid support and a deformable buffer mounted on the support.

BACKGROUND OF THE INVENTION

When fabricating ophthalmic lenses, prior tools of the above-indicated type are generally used as polishers for polishing or clear-polishing the surface of an ophthalmic lens, or else as an applicator buffer for applying an adhesive film on the surface of the lens in order to protect it against scratching or against being corroded by foreign bodies, for example during "blocking" when a metal block is fixed on one of the faces of the lens by casting a low melting point metal thereon in order to enable the lens subsequently to be mounted on the lens holder of a machine for processing ophthalmic lenses, e.g. a surfacing machine, an edging machine, or a polishing machine. In all of these cases, the buffer of the tool must be capable of fitting closely over the entire surface of the lens against which it is applied. However, given the wide range of radii of curvature in ophthalmic lenses, and given that the surface of an ophthalmic lens may comprise a plurality of different radii of curvature (multi-focus lenses and toric lenses), it has been necessary to have a set of tools available, with each tool being adapted to a given radius of curvature.

The object of the present invention is therefore to provide a single tool of automatically-adapting shape which is capable of fitting closely over the entire surface of an ophthalmic lens with a substantially uniform application pressure, regardless of the radius of curvature of the lens.

SUMMARY OF THE INVENTION

To this end, the present invention provides a tool whose shape adapts automatically to the surface of an ophthalmic lens, the tool comprising a rigid support and a deformable buffer mounted on the support, wherein the support includes a cavity in one of its faces, wherein the buffer comprises two elastically deformable membranes whose peripheral edges are fixed to the side walls of said cavity at a distance from the bottom of the cavity, thereby defining a space between the membranes, which space is filled with an incompressible material constituted by small-size grains, and wherein the support further includes a passage having one end opening out into said space and having its other end connectable to a vacuum source.

The incompressible material may be constituted, for example, by sand or by small-diameter beads. For example, the beads may have a diameter lying in the range 0.5 mm to 3.5 mm, and may preferably be 1 mm in diameter. The beads may be made of glass or of metal. Both of the membranes may be made of an elastomer material, e.g. latex, and they may be 0.5 mm to 1 mm thick, for example.

BRIEF DESCRIPTION OF THE DRAWING

An embodiment of the invention is described by way of example with reference to the sole figure of the accompanying drawing which is an axial section through one embodiment of the tool.

MORE DETAILED DESCRIPTION

The tool shown in the drawing is essentially constituted by a deformable buffer 1 carried by a rigid support 2. The support 2 comprises a first support part 2*a* which is cupshaped, and two other support-parts 2*b* and 2*c* which are ringshaped and of substantially the same diameter as the first support part 2*a*. The three support parts 2*a*, 2*b*, and 2*c* are fixed to one another coaxially, e.g. by means of screws 3 and 4, and together they form a relatively deep cavity 5 in one of the faces of the support 2. On its side opposite to the side having the cavity 5, the support 2 includes means 6 enabling it to be connected to a tool-carrier, for example in the form of a projection having a tapped blind hole therein, as shown in the figure.

The deformable buffer 1 is constituted by two membranes 7 and 8 made of latex, which membranes are stretched across the cavity 5 and are fixed by having their peripheries clamped respectively between the parts 2*a* and 2*b*, and between the parts 2*b* and 2*c* of the support. The space 9 between the two membranes 7 and 8 is filled with small diameter beads 11, for example glass beads having a diameter of 1 mm.

The part 2*b* of the support 2 includes a radial passage 12 which opens out at one end into the space 9 and which is connected at its other end via a connector 13 and a pipe 14 to a vacuum source 15. A three-path valve 16 is inserted on the pipe 14, and depending on its position serves to put the space 9 into communication either with the vacuum source 15 or else with the atmosphere. A filter 17 having a mesh size which is smaller than the diameter of the beads 11 is provided in the passage 12 in order to prevent the beads 11 from being sucked into the pipe 14 when a vacuum is established therein by the source 15.

Although not absolutely essential for convex lenses, part 2*a* of the support 2 also includes a passage 18 which opens out at one end into the cavity 5 between the bottom of the cavity and the membrane 7, and at its other end is connected via a connector 19 and a pipe 21 to a three-position valve 22. Depending on its position, the valve 22 puts the pipe 21 into communication either with the atmosphere, or with the vacuum source 15 via a pipe 23, or else with a source of compressed air 24 via a pipe 25. As explained below, this enables the buffer 1 to adapt more easily to the surface of a lens when the lens has a small radius of curvature or when the buffer is to be applied against a concave lens surface.

The operation of the tool is now described assuming, initially, that it is to be applied against a convex surface $S_1$ of a lens L. The lens L is placed on a support 26. At least one of the two supports 2 and 26 is movable relative to the other so as to enable them to be moved towards each other and away from each other as indicated by double-headed arrow F. While the two pipes 14 and 21 are in communication with the atmosphere, the two supports 2 and 26 are moved towards each other. The lens L deforms the membrane 8 which then fits closely over the convex face $S_1$ of the lens. Thereafter, the valve 16 is switched so as to put the space 9 into communication with the vacuum source 15. This has the effect of causing the assembly 7, 8, and 11 to become completely rigid, and as a result the membrane 8 retains the shape of the convex surface $S_1$ exactly. This means that the force by which the buffer 1 is pressed against the surfce $S_1$ is distributed uniformly over all of said surface. If the tool is used as a polisher, the membrane 8 may be lined with a polishing material, e.g. a felt.

When the surface $S_1$ has a small radius of curvature, deformation of the assembly 7, 8, and 11 may be facilitated by initially putting the pipe 21 into communication with the vacuum source 15 via the valve 22 while the space 9 between the two membranes 7 and 8 is still in communication with the atmosphere. Thereafter, the space 9 can be put into communication with the vacuum source 15 via the valve 16 as described above in order to make the assembly 7, 8, and 11 rigid.

Once the buffer 1 has adapted to the shape of the surface $S_1$ and has been made rigid as described above, the space between the membrane 7 and the bottom of the cavity 5 may be put into communication with the source of compressed air 24 via the pipe 21, the valve 22, and the pipe 25 in order to counterbalance the force by which the lens L is pressed against the buffer 1, in particular when the tool is used as a surfacing tool or as a polishing tool.

When the tool is to be applied against a concave surface $S_2$ of an ophthalmic lens, the space between the membrane 7 and the bottom of the cavity 5 is initially put into communication with the source of compressed air via the pipe 21, the valve 22, and the pipe 25 while the space 9 between the two membranes 7 and 8 is still in communication with the atmosphere, thereby urging the assembly 7, 8, and 11 against the concave surface of the lens. Thereafter, once the membrane 8 has taken up the shape of the concave surface of the lens, the space 9 is put into communication with the vacuum source 15 via the pipe 14 and the valve 16 in order to make the assembly 7, 8, and 11 rigid, as described above.

In any event, it may be observed that once the membrane 8 has taken up the shape of the concave or convex surface of the lens, and the assembly 7, 8, and 11 has been made rigid by putting the space 9 under a vacuum, the thrust force between the buffer 1 and the lens L is distributed uniformly over the entire area of contact between the membrane 8 and the lens.

When the automatically-adapting tool is used for applying a film of adhesive on an ophthalmic lens, the tool is essentially used as a "surface memory". The forces applied to the tool are small and it is possible to use beads 11 made of glass, which is a material having a low coefficient of friction. In contrast, if the automatically-adapting tool is used as a surfacing tool, it is necessary to have an assembly which is very rigid in order to avoid its surface shape becoming deformed under machining forces, in which case it is necessary to use beads or grains 11 having a high coefficient of friction (e.g. made of aluminum or of steel). Further, in this second application, because of the relative surfacing motion which takes place between the tool and the lens to be surfaced, it is necessary to give the tool its initial shape by pressing it against a preform having the desired radius (or radii) of curvature and having a diameter which is greater than the largest diameter of the lenses to be surfaced.

Naturally, the above-described embodiment of the present invention is given purely by way of non-limiting example, and numerous modifications may easily be made by the person skilled in the art without thereby going beyond the scope of the invention.

We claim:

1. A tool whose shape adapts automatically to the surface of an ophthalmic lens, the tool comprising a rigid support and a deformable buffer mounted on the support, wherein the support includes a cavity in one of its faces, wherein the buffer comprises two elastically deformable membranes whose peripheral edges are fixed to the side walls of said cavity at a distance from the bottom of the cavity thereby defining a space between the membranes, which space is filled with an incompressible material constituted by small-size grains, and wherein the support further includes a passage having one end opening out into said space and having its other end connectable to a vacuum source.

2. A tool according to claim 1, wherein the incompressible material is constituted by beads having a diameter of between 0.5 mm and 3.5 mm.

3. A tool according to claim 2, wherein said beads have a diameter of 1 mm.

4. A tool according to claim 1, wherein said small-size grains are beads made of glass or metal.

5. A tool according to claim 1, wherein the incompressible material is constituted by sand.

6. A tool according to claim 1, wherein the membranes are made of an elastomer material.

7. A tool according to claim 6, wherein the membranes are made of latex.

8. A tool according to claim 7, wherein the membranes are 0.5 mm to 1 mm thick.

9. A tool according to claim 1, wherein the support includes a second passage having one end opening out into said cavity between the bottom of the cavity and that one of the membranes which is closest to the bottom, and having its other end selectably connectable to a vacuum source or to a source of compressed air.

10. A tool according to claim 9, wherein the support comprises a cup-shaped first part and ring-shaped second and third parts, said parts being of substantially the same diameter, said three support parts being fixed together coaxially, wherein one of said two membranes has its peripheral edge clamped between the first and second parts and the other of said two membranes has its peripheral edge clamped between said second and third parts, and wherein said passages pass radially through said first and second parts respectively.

* * * * *